US008657576B2

(12) United States Patent
Tibbott et al.

(10) Patent No.: US 8,657,576 B2
(45) Date of Patent: Feb. 25, 2014

(54) ROTOR BLADE

(75) Inventors: Ian Tibbott, Lichfield (GB); Roderick M. Townes, Derby (GB)

(73) Assignee: Rolls-Royce PLC, London (GB)

( * ) Notice: Subject to any disclaimer, the term of this patent is extended or adjusted under 35 U.S.C. 154(b) by 634 days.

(21) Appl. No.: 12/457,450

(22) Filed: Jun. 11, 2009

(65) Prior Publication Data

US 2009/0317258 A1 Dec. 24, 2009

(30) Foreign Application Priority Data

Jun. 23, 2008 (GB) ..... 0811391.2

(51) Int. Cl.
*F01D 5/18* (2006.01)

(52) U.S. Cl.
USPC ..... 416/96 R

(58) Field of Classification Search
USPC ..... 415/115; 416/95, 96 R, 97 R
See application file for complete search history.

(56) References Cited

U.S. PATENT DOCUMENTS

| | | | | |
|---|---|---|---|---|
| 4,992,025 | A * | 2/1991 | Stroud et al. | 416/97 R |
| 5,059,093 | A * | 10/1991 | Khalid et al. | 415/115 |
| 5,690,473 | A * | 11/1997 | Kercher | 416/97 A |
| 7,018,176 | B2 * | 3/2006 | Mongillo et al. | 416/97 R |
| 7,137,781 | B2 * | 11/2006 | Harvey et al. | 416/96 A |
| 7,722,326 | B2 * | 5/2010 | Beeck et al. | 416/97 R |
| 7,922,451 | B1 * | 4/2011 | Liang | 416/97 R |
| 8,092,176 | B2 * | 1/2012 | Liang | 416/96 R |
| 2002/0168264 | A1 | 11/2002 | Weigand et al. | |
| 2005/0111981 | A1 | 5/2005 | Davison et al. | |
| 2010/0115967 | A1 * | 5/2010 | Maltson | 60/806 |

FOREIGN PATENT DOCUMENTS

| | | | |
|---|---|---|---|
| EP | 1 593 812 | A2 | 11/2005 |
| EP | 1 659 264 | A2 | 5/2006 |
| EP | 1 975 372 | A1 | 10/2008 |
| GB | 2 243 486 | A | 5/2000 |
| WO | WO 2008116906 | A1 * | 10/2008 |

OTHER PUBLICATIONS

Search Report issued in European Application No. 09251535 dated Jun. 15, 2012.

* cited by examiner

*Primary Examiner* — Nathaniel Wiehe
*Assistant Examiner* — Ryan Ellis
(74) *Attorney, Agent, or Firm* — Oliff PLC

(57) ABSTRACT

Cooling within aerofoils (30, 47, 67, 87) is a requirement in order that the materials from which the aerofoil (30, 47, 67, 87) is created can remain within acceptable operational parameters. Traditionally static pressure as well as enhanced dynamic pressure impingement flows have been utilized but there are problems with regard to achieving a necessary over pressure to avoid hot gas ingestion or reduced cooling effect. It will be appreciated that fluid flows and in particular coolant fluid flows must be used most appropriately in order to maintain operational efficiency. By providing a plurality of feed apertures (41, 61, 81) which are shaped to have an entry portion (51, 71, 91) which is generally elliptical and an exit portion (52, 72, 92) it is possible to grab and turn a proportion of a feed flow (44, 64, 84) for substantially perpendicular or other angular presentation to an opposed surface of a cooling chamber (42, 62, 82) within which cooling is required.

14 Claims, 6 Drawing Sheets

ROTOR BLADE

BACKGROUND

The present invention relates to rotor blades and more particularly to turbine rotor blades utilised in gas turbine engines.

Referring to FIG. 1, a gas turbine engine is generally indicated at 10 and comprises, in axial flow series, an air intake 11, a propulsive fan 12, an intermediate pressure compressor 13, a high pressure compressor 14, a combustor 15, a turbine arrangement comprising a high pressure turbine 16, an intermediate pressure turbine 17 and a low pressure turbine 18, and an exhaust nozzle 19.

The gas turbine engine 10 operates in a conventional manner so that air entering the intake 11 is accelerated by the fan 12 which produce two air flows: a first air flow into the intermediate pressure compressor 13 and a second air flow which provides propulsive thrust. The intermediate pressure compressor compresses the air flow directed into it before delivering that air to the high pressure compressor 14 where further compression takes place.

The compressed air exhausted from the high pressure compressor 14 is directed into the combustor 15 where it is mixed with fuel and the mixture combusted. The resultant hot combustion products then expand through, and thereby drive, the high, intermediate and low pressure turbines 16, 17 and 18 before being exhausted through the nozzle 19 to provide additional propulsive thrust. The high, intermediate and low pressure turbines 16, 17 and 18 respectively drive the high and intermediate pressure compressors 14 and 13 and the fan 12 by suitable interconnecting shafts 26, 28, 30.

SUMMARY

The performance of a gas turbine engine cycle, whether measured in terms of efficiency or specific output is improved by increasing turbine gas temperature. Thus, it is desirable to operate the turbine at its highest possible gas temperature and increasing gas turbine entry gas temperature will always produce more specific thrust. Unfortunately, as turbine entry temperatures increase, the life of an uncooled turbine rapidly diminishes so requiring better materials and utilisation of internal cooling within the blade.

In modern engines high pressure turbine gas temperatures are generally much hotter than the melting point of the materials from which the blades are made and so cooling is required. Furthermore, intermediate and low pressure turbines also will require cooling in order to achieve acceptable operational life. During passage through the turbine the mean temperature of a gas stream decreases as power is extracted. In such circumstances the need to cool the static and rotating parts of the engine decrease as the gas moves from the high temperature stages through the intermediate stages to the low pressure stages towards the exit nozzle of the engine.

Previously, internal convection and external films have been utilised as the primary methods for cooling rotor blades. In such circumstances high pressure turbine nozzle guide vanes consume great volumes of coolant air whilst the high pressure blades typically use about half of that required for the nozzle guide vanes. The intermediate and low pressure stages downstream of the high pressure turbine progressively use less coolant air.

It will be understood that blades and vanes are cooled using high pressure coolant air taken from the compressor stages which has bypassed the combustor and is therefore relatively cool compared to the engine. For illustration purposes the coolant air temperature will be in the order of 700 to 1,000 K whilst the gas temperature in the high pressure turbine stage will be in excess of 2,100 K. Coolant air taken from the compressor in order to cool the turbine results in a reduction in engine operating efficiency. It will be appreciated that the coolant air extracted does not produce thrust and in such circumstances has an adverse effect. In the above circumstances it will be appreciated that it is important that the amount of cooling air is minimised and it is used as effectively as possible.

With regard to gas turbine engines cooling regimes are known but cooling of the leading and trailing edges of aerofoils is very difficult. In such circumstances, generally separate chambers or cavities are configured in the aerofoil into which impingement air is fed and directed to the leading and trailing edges.

Impingement cooling can produce high levels of internal heat transfer for cooling of the aerofoil. Furthermore, cooling is improved by sufficiently high pressure ratios across the impingement holes of the cooling arrangement. However, increasing pressure ratio may be difficult as impingement gas pressure cannot be varied due to a requirement for a minimum pressure to prevent hot gas ingestion into the coolant chamber. Similarly, increasing the feed pressure for cooling will be less efficient due to increased leakage of coolant.

Recent impingement cooling systems have involved orientating generally cylindrical shaped impingement jets through an angle of approximately 30° to 40° to the perpendicular. This change in geometry has the effect of improving the entrance loss and allowing the feed pressure to increase from the static flow pressure to a higher pressure comprising the static pressure plus a proportion of the dynamic pressure due to local velocity of the flow in the feed passage. In such circumstances the pressure ratio across the impingement jets can be increased without changing the incident static blade feed pressure taken from the by-pass.

An unfortunate consequence of the above approach is that the resulting impingement jets are directed in such a way that they strike the inner surface of a cooling cavity at an angle. Such angling causes the impingement jets to provide an engagement footprint which is elliptical in shape rather than a focussed circular incidence and therefore spreads the effective cooling effect over a greater area. Such an approach weakens the overall level of heat transfer and so cooling effectiveness. It will be understood that high levels of heat transfer are required and desirable for efficiency. In such circumstances, relatively moderate values for impingement angle will increase pressure ratio across the impingement jets but the benefits are more than offset by the loss of heat transfer effectiveness due to the jets striking the target area at an angle with as indicated resultant spread and weakening of the level of heat transfer over a bigger area. However, with cylindrical shaped impingement orifices which are presently perpendicularly it will be understood that the benefits of higher feed pressures are lost in that a dynamic pressure component cannot be provided.

Although alternative configurations may include provision of pedestals or pin fins in the feed passage to direct cooling flow it will be understood these features will also partially obstruct flow and therefore act as deflectors to the flow. Furthermore aligning the direction of the deflected flow to the apertures or orifices for impingement direction can be difficult and may result in entrance losses to the apertures.

Accordingly the present invention provides an aerofoil for a gas turbine engine, the aerofoil comprises a passage partly defined by a divider wall, along which coolant flows, and a chamber defined partly by the divider wall and a chamber wall, a plurality of feed apertures is defined in the divider wall to supply the coolant to impinge on the chamber wall, the feed apertures comprise a centre-line, an entry plane and an exit plane, the aerofoil is characterised in that at least one of the feed apertures comprises a centre-line that is non-linear, in a plane parallel to the coolant flow, between the entry plane and the exit plane.

Preferably, the divider wall comprises a thickened part through which the feed apertures are defined.

The centre-line at the entry plane may be angled θ up to 90 degrees from the coolant flow direction. Preferably, the centre-line at the entry plane is angled θ between 30 and 60 degrees from the coolant flow direction and in an exemplary embodiment the centre-line at the entry plane is angled θ at approximately 45 degrees from the coolant flow direction.

Optionally, the plurality of apertures are comprises apertures having different angles θ to preferentially vary the amount of coolant channelled through the apertures.

Preferably, the centre-line at the exit plane is angled α up to 30 degrees to the surface of the chamber wall. In an exemplary embodiment the centre-line at the exit plane is angled α at 90+/−10 degrees to the surface of the chamber wall.

Optionally, the plurality of apertures are comprises apertures having different angles α to preferentially vary the direction of coolant impinging on the chamber wall.

Preferably, at least one aperture comprises a convergent part between the entry plane and the exit plane.

Preferably, at least one aperture comprises a divergent part between the entry plane and the exit plane.

Preferably, at least one aperture comprises a greater entry plane area than the exit plane area.

Optionally, the plurality of apertures comprises apertures having different entry plane areas to preferentially direct different amounts of coolant therethrough.

Preferably, at least one aperture comprises an elliptical entry plane.

Preferably, at least one aperture comprises an elliptical or circular exit plane.

In accordance with another aspect of the present invention there is provided an aerofoil for a gas turbine engine, the aerofoil including a passage having a plurality of feed apertures to a cooling cavity, the aerofoil associated with means to stimulate fluid flow in the passage, the aerofoil characterised in that at least some of the feed apertures have an elliptical entry and a shaped exit, the elliptical entry orientated to gather the fluid flow and the exit orientated to eject the fluid flow through the feed aperture towards an opposed portion of the cooling chamber at a desired angle.

Generally, the means to stimulate fluid flow is at least in part static pressure in the fluid.

Typically, the desired angle is perpendicular.

Generally, the shaped exit is circular. Alternatively, the shaped exit is elliptical. Possibly the shaped exit provides a wider cross sectional area than the entry. Alternatively, the elliptical exit is narrower than the entry.

Generally, the cavity includes edge apertures.

Possibly, the feed apertures are shaped between the entry and the exit for fluid flow ejection.

Possibly, the passage incorporates deflectors to deflect the fluid flow towards the entry.

Possibly, the fluid flow is ejected by the feed aperture perpendicular to the opposed portion of the cavity.

Possibly, the apertures are all substantially of the same size. Alternatively, the apertures have different sizes dependent upon their position within the aerofoil. Generally, a plurality of apertures is provided in a regular pattern in a divider wall between the passage and the cooling cavity.

Also in accordance with aspects of the present invention there is provided a gas turbine engine incorporating an aerofoil as described above.

BRIEF DESCRIPTION OF THE DRAWINGS

Aspects of the present invention will now be described by way of example with reference to the accompanying drawings in which.

DETAILED DESCRIPTION OF THE EMBODIMENTS

Figure 1:
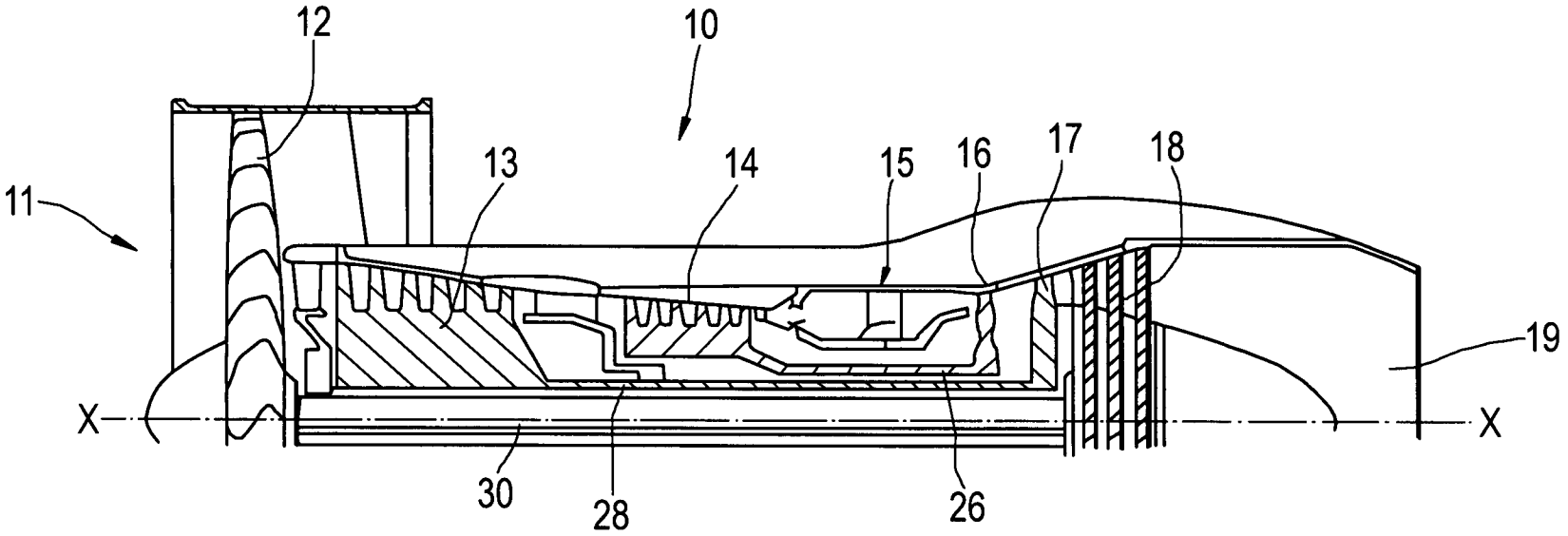
FIG. 1 is a part section through an schematic illustration of a conventional gas turbine engine.

The term radial refers to the rotational axis of the engine shown in FIG. 1.

Figure 2:
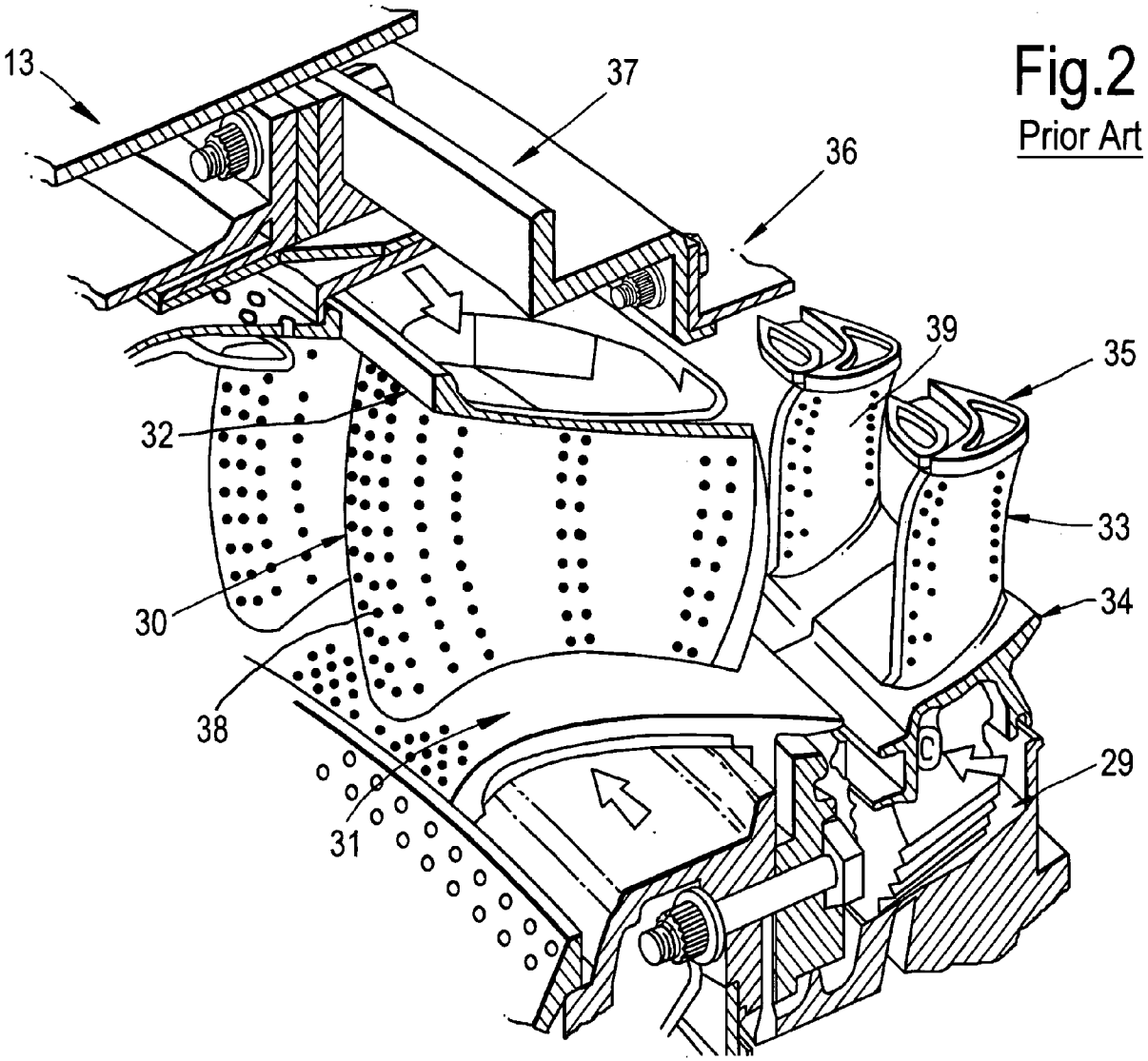
Fig.2 Prior Art
FIG. 2 is a pictorial part perspective view of aerofoils, and in particular nozzle guide vane and rotor blade aerofoils utilised in a gas turbine engine.

FIG. 2 provides a part perspective view of a turbine section of a gas turbine engine. Thus, an aerofoil 30 is secured between an inner platform 31 and an outer platform 32. The aerofoil 30 acts as a nozzle guide vane directing and guiding a hot gas flow in co-operation with other aerofoils as nozzle guide vanes towards rotor blades 33 themselves formed as aerofoils. The rotor blades 33 are assembled upon a rotor mounting through a root fixing 29 and are arranged to rotate in use. It will be noted that the rotor blades 33 include a platform 34 at one end and a wing portion 35 at the other to act in association with a seal shroud 36. The whole arrangement is supported on a suitable support structure such as a turbine support casing 37.

As indicated above the aerofoils 30, 33 defining the nozzle guide vanes and rotor blades in accordance with aspects of the present invention incorporate apertures 38, 39 about their surface in order to define in use film cooling upon those surfaces. It will also be appreciated that the coolant flows within the aerofoils 30, 33 typically through multi-pass processes cool the aerofoils 30, 33 as components before presentation of the film cooling after ejection through the apertures 38, 39. It is obtaining best effective use of the coolant flows, particularly with regard to the aerofoils 30, 33, which is of particular concern with respect to aspects of the present invention.

As indicated above simple perpendicular presentation of an aerofoil flow does not allow enhancement of the static pressure of that flow and therefore greater cooling effect. By provision of angled apertures or feed paths it is possible to create enhanced flow pressure, that is to say by utilising static and flow pressure. Unfortunately, angular presentation results in an impingement footprint which is smeared and therefore reduces the cooling effects upon impingement with an engaged wall surface.

Aspects of the present invention attempt to combine the benefits of focused presentation of a coolant flow to a portion of a surface to be cooled whilst achieving enhanced feed pressure for the fluid flow.

Figure 3:
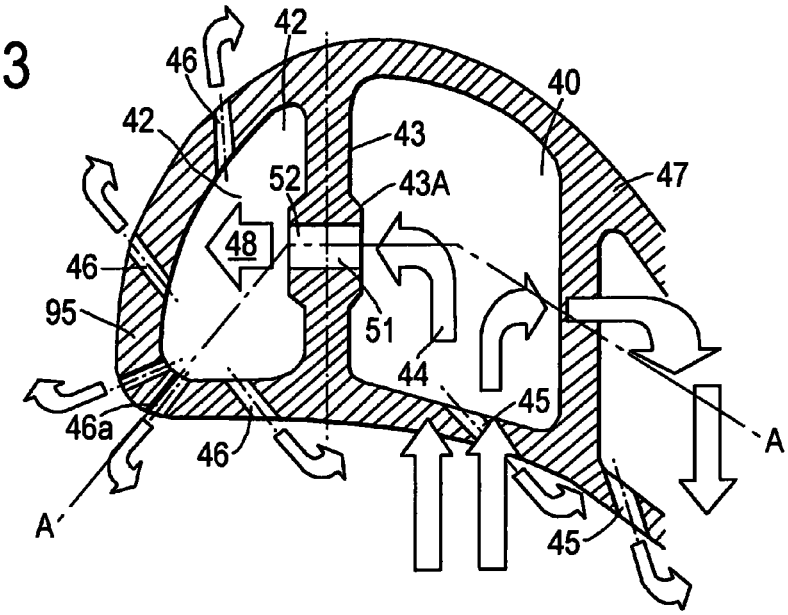
FIG. 3 is a mid span cross section of an aerofoil leading edge in accordance with a first embodiment of aspects of the present invention.

FIG. 3 provides a schematic part cross section of a leading edge region of an aerofoil in accordance with the present invention. A radial passage 40 provides a fluid flow in the form of a coolant to a series of shaped orifices or feed apertures 41 in a divider wall 43 between the passage 40 and a cooling chamber or cavity 42. In a first embodiment depicted in FIG. 3 the divider wall 43 has been locally thickened 43A to accommodate and enhance the effectiveness of the apertures 41. As will be described later this thickened wall 43A will allow formation of specific shaping for each feed aperture 41.

In operation it will be appreciated that fluid flow in the form of coolant 44 will pass radially outwardly along the radial passage 40 and as indicated exit through the feed aperture 41 as well as surface apertures 45 and edge apertures 46. The coolant or fluid flow 44 will provide internal cooling within the aerofoil 47 as well as film cooling on the surface of the aerofoil 47 through coolant ejected through the apertures 45, 46. In order to improve cooling effectiveness as indicated an impingement jet 48, derived from coolant flow 44, through the feed aperture 41 is directed to impinge substantially at a perpendicular angle with an opposed wall portion 95 partly forming the chamber 42.

Figure 4:
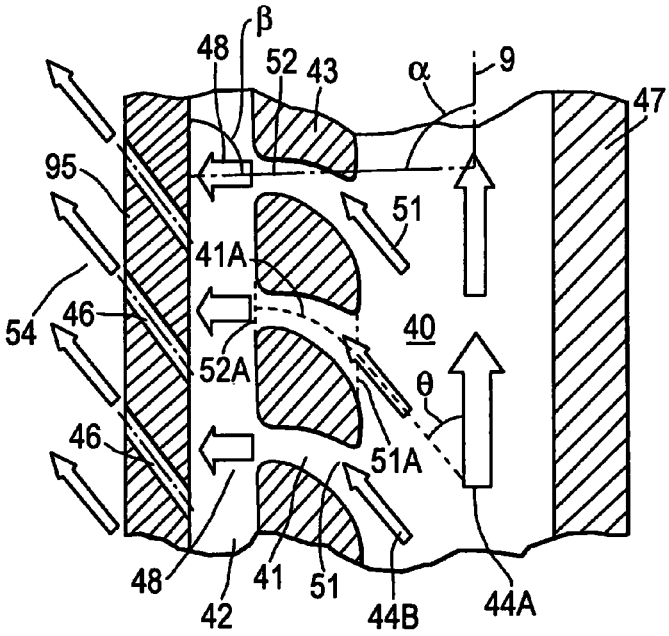
FIG. 4 is a cross section of the aerofoil along the line A-A depicted in FIG. 3.

FIG. 4 shows a section A-A as depicted in FIG. 3, that is to say a sectional view through an aperture 41 depicted and leading edge aperture 46*a*. The feed fluid flow 44 passes through in the direction of arrowheads 44*a* with a feed pressure comprising the static pressure of the flow. The feed apertures 41 are shaped such that an entry part 51 is generally elliptical whilst an exit part 52 is generally circular. By such shaping it will be appreciated that a proportion of the feed fluid flow 44*b* is gathered by the elliptical entrance portion 51 and passes through the feed aperture 41 and out of the exit part 52 such that it is projected substantially perpendicularly to respective wall portions of the chamber 42. With such perpendicular impingement more focussed heat transfer cooling occurs and subsequently the fluid flow as coolant passes through the edge apertures 46 in order to create a film cooling effect 54.

The aperture(s) comprises an entry plane 51A and an exit plane 52A; the area of the entry plane is greater than the area of the exit plane 52A. The aperture(s) 41 has a centre-line 41A that is angled θ at to the coolant flow, which in this example, is in the radial direction; the centre-line is curved in the plane shown in FIG. 4. As shown in this embodiment, the angle θ is approximately 45°, but any angle would be beneficial although between 30° and 60° is most preferably. The centre-line passing through the exit has an angle α which is preferably approximately 90° (+/−10°) to the surface of the wall 95, although angles up to 30° to the surface would be beneficial. Thus the coolant flow 48 impinges on the surface of the wall 95 at an angle β which is preferably approximately 90°(+/−10°) to the surface of the wall 95. Angles β of up to 30° to the surface would be beneficial.

For the avoidance of doubt the centre-line, in this and the other embodiments, is a line that intersects a geometric centre of area at any cross-section. In general, it should be appreciated that the invention relates to at least one of the feed apertures comprising a centre-line that is non-linear in a plane parallel to the coolant flow, which is usually in a radial direction with respect to an aerofoil, between the entry plane and the exit plane. This parallel plane is that defined by the sections shown in the exemplary FIGS. 4, 6 and 8.

It is by shaping the feed apertures 41 in a particular manner that the radial velocity component of the impingement feed 44*b* is projected in order to create the impingement jets 48 as described previously. The entrainment is achieved through elliptical shaping of the entry portions 51 before acceleration along the converging shaped aperture 61 acting as a guiding passage in the divider wall 43. The impingement flow jet 48 emerges through typically as illustrated a circular exit portion 52 (when α=90o) which is therefore cylindrically shaped and presented at an angle predominantly perpendicular to the opposed surface portions of the chamber 42. For other angles α the impingement footprint of the impingement jets 48 is therefore elliptical.

By shaping the entrance portions 51 the ejected impingement jets 48 can be maximised to ensure that a dynamic pressure component is additive to the static pressure component. An enhanced feed pressure is achieved with the impingement configuration as depicted in FIG. 3 and FIG. 4, which enhances and maximises feed pressure by choice of the appropriate inlet angle through the elliptical entry portion 51. By the convergence of the sides of the feed aperture 41 towards the exit portion 52 as indicated an impingement jet 48 is created which strikes the wall at a desired angle which is typically perpendicular in order to concentrate heat transfer over a focused area of the opposed portion of a chamber 42 surface subject to impingement by the impingement jets 48.

It is by a combination of the elliptical entry portion 51 and the shaping of the exit portion 52 that appropriate presentation of the impingement jets 48 towards the opposed portions of the chamber 42 can be achieved. It will be appreciated that in order to maximise the effectiveness of the feed flow 44*a* the angle θ may be adapted which alters the entry plane area 51A shape at the elliptical entry portion 51 may be varied along the length of the aerofoil 47 in order to preferentially cool parts of the wall 95. It will be appreciated that generally most cooling is required at the mid-portion and therefore in order to maximise flow at this point elliptical shaping of the entry portions 51 may be tailored to channel the feed fluid flow 44 whilst other portions may be tailored to have a reduced effectiveness with respect to ingestion of the coolant feed flow 44 at root and tip portions of the aerofoil 47. Here the angle θ of the centre-line 41A of the aperture 41 at the inlet plane is greater where more coolant is desired, in this case, adjacent to the mid-height region of the aerofoil than near the tip or root regions. With a greater angle θ more coolant is drawn into the aperture. Additionally, the degree of convergence and constriction provided between the entry portion 51 and the shaped exit portion 52 can be adjusted at different locations along the aerofoil 47 to provide greater or lesser presentation of the impingement jet 48 for differing cooling effect.

Figure 5A:
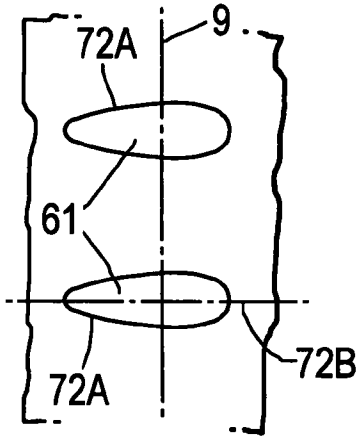
FIG. 5A is a view on arrow D in FIG. 5.
Figure 5:
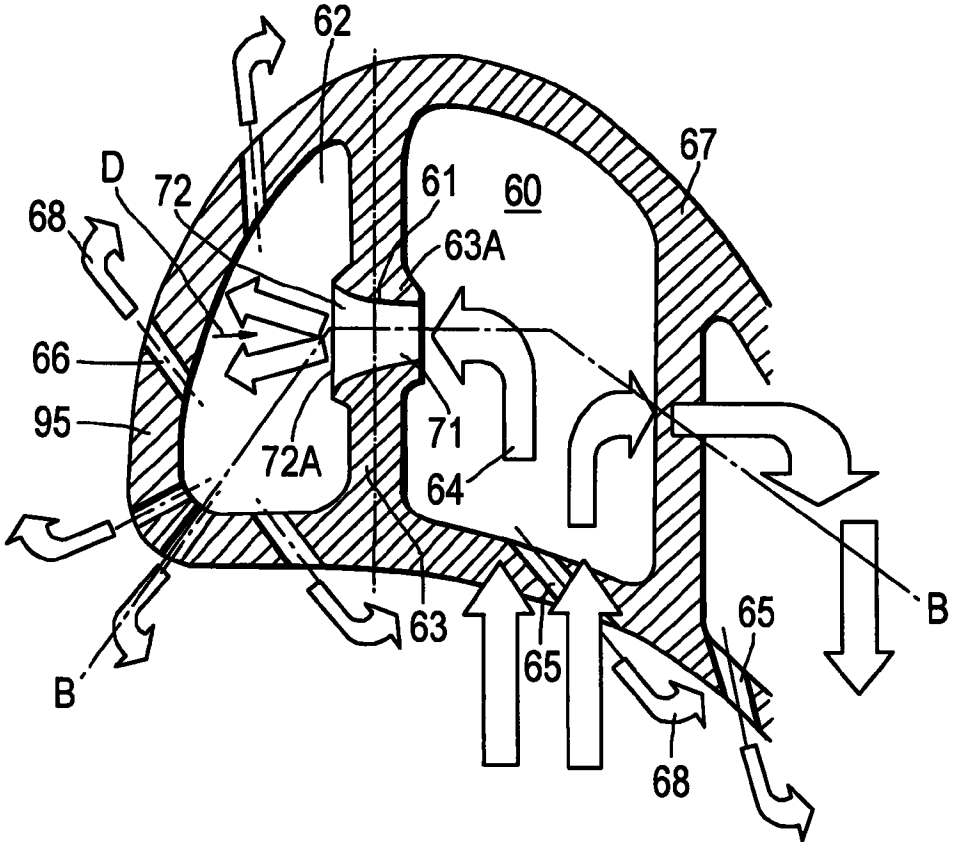
FIG. 5 is a part cross section of a second embodiment of an aerofoil in accordance with aspects of the present invention with regard to the leading edge.
Figure 6A:
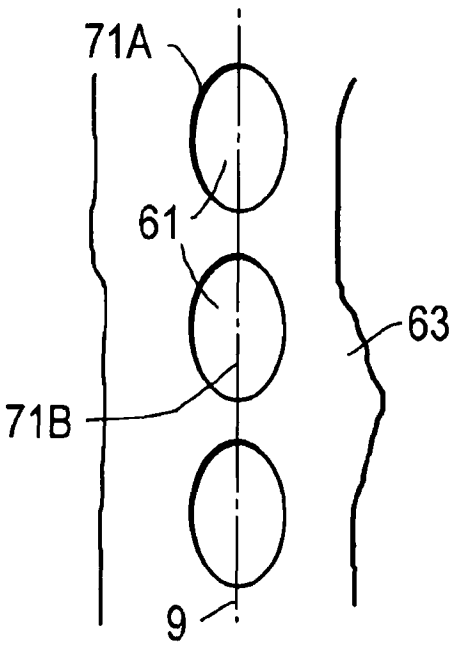
FIG. 6A is a view on arrow E in FIG. 6.
Figure 6:
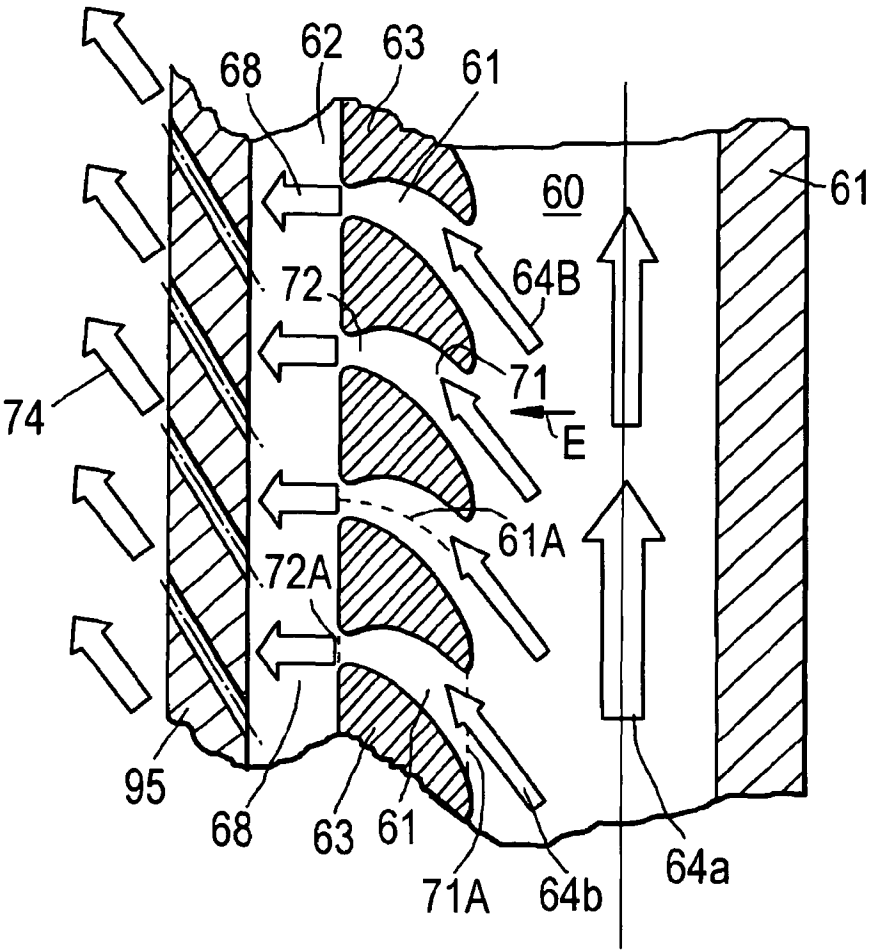
FIG. 6 is a schematic cross section along the line B-B of the aerofoil depicted in FIG. 5.

FIG. 5 and FIG. 6 provide illustrations of a second embodiment of the present invention in which the entry portion is again elliptical in shape whilst the exit portion has an elliptical shape diverging between the entry portion and the exit portion. FIG. 5 provides a schematic part cross section of a leading edge portion of an aerofoil 67. As previously a passage 60 receives a fluid flow 64 which is projected radially and enters feed apertures 61 for projection and presentation into a chamber or cavity 62 towards an opposed portion of the wall 95 of the cavity. The fluid flow is typically a coolant flow and therefore provides a cooling effect within the chamber 62 and the wall 95 before egress through apertures 66 to define the coolant film on the aerofoil 67 external surface. A dividing wall 63 is provided between the passage 60 and the chamber 62. The dividing wall 63 comprises a locally thickened part 63A in order to allow earlier provision of the feed aperture 61. The thickened part 63A allows a longer aperture 41 and one that is sufficient to turn the coolant flow as described herein. In the above circumstances as indicated the fluid flow 64 provides a cooling effect within the chamber 62 initially and then upon the egress from the edge apertures 66 creates film cooling 68 about the aerofoil 67.

The second embodiment depicted in FIG. 5 and FIG. 6 differs from the first embodiment with regard to the shaping of the feed apertures 61. The apertures 61 comprise an entry portion 71 having an entry plane 71A, an exit portion 72 having an exit plane 72A and a centre-line 61A. As previously with the first embodiment the entry plane 71A is elliptical having a major axis 71B (FIG. 6A) aligned with the direction of flow 64*a* which is itself aligned with a radial line 9 with respect to the aerofoil, that is to say the root to tip. Again as previously with regard to the first embodiment depicted with respect to FIGS. 3 and 4, part of the fluid flow 64*a* is channelled through the shaping of the entry plane 71A and accelerated and turned within the feed aperture 61, along the curved centre-line 61A having an angle θ at the entry plane, in a manner such that it emerges through the exit portion 72. Such emergence is again substantially perpendicular towards an opposed wall portion of the chamber 62.

FIG. 5A is a view on arrow D in FIG. 5 and shows the aperture's exit plane 72A, which is an elliptical shape. A major axis 72B of the elliptical exit plane 72A is approximately perpendicular to the radial line 9. FIG. 6A is a view on arrow E in FIG. 6 and shows the aperture's entry plane 71A, which is an elliptical shape. A major axis 71B of the entry plane is approximately parallel to the radial line 9, and more importantly the direction of the flow 64*a*. However, the major axes 71B, 72B may vary by up to 45° while still being useful.

The impingement footprint of the impingement flow 68 is elliptical in shape with its minor axis aligned in the radial direction with respect of the blade geometry, that is to say root to tip. The configuration as depicted in FIG. 5 and FIG. 6 is better suited to nozzle guide vane aerofoils due to the fact that the elliptical shape of the impingement jet 68 exits would increase stress concentration in a rotor blade application due to centrifugal loading. Nevertheless, the spread of the impingement jet 68 from each feed aperture 61 in the aerofoil 67 will improve cooling effects in a static nozzle guide vane aerofoil cooling arrangement. Furthermore, it will be noted that an inner surface of the chamber 62 is curved (see FIG. 5, wall 95). In such circumstances by reciprocal shaping of the elliptical diverging exit portion 72 the direction of the impingement jets or flow 68 may be rendered still more perpendicular to the opposed surface of the chamber 62.

The area of the entry plane, for all embodiments herein, is preferably greater than the exit plane area of the aperture (41, 61, 81) and therefore coolant flow through the aperture is accelerated from entry to exit to improve its impingement cooling effect on wall 95. It should be noted that the degree of convergence in FIG. 6 of aperture 61 is greater than its divergence in the orthogonal plane (viz FIG. 6 and FIG. 5).

Nonetheless, the aperture(s) (41, 61, 81) may be convergent-divergent having a greater exit plane area than entry plane area. This may be where a greater area of the wall 95 requires impingement cooling for example.

Figure 7:
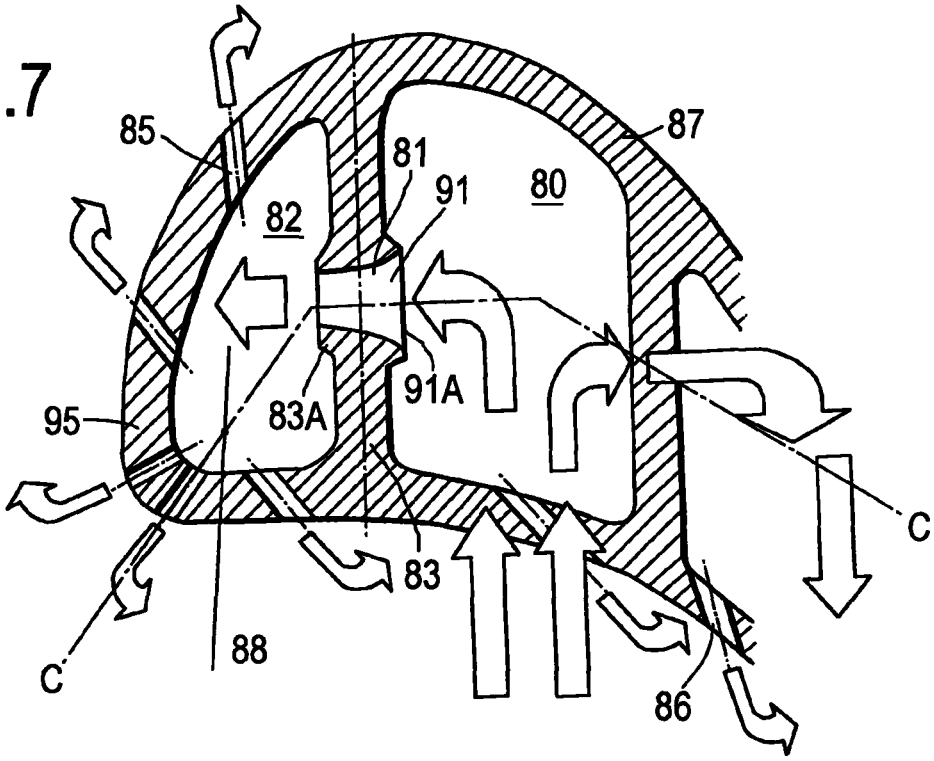
FIG. 7 is a schematic part cross section of a leading edge of a third embodiment of an aerofoil in accordance with aspects of the present invention.
Figure 8:
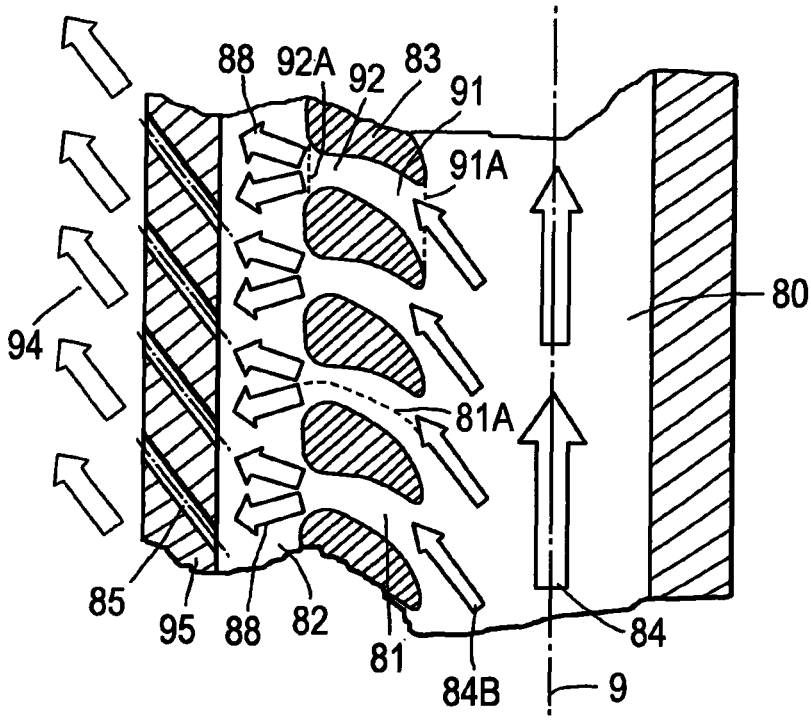
FIG. 8 is a schematic view of the aerofoil along the direction C-C depicted in FIG. 7.

FIGS. 7 and 8 provide an illustration of a third embodiment of an aerofoil in accordance with aspects of the present invention. FIG. 7 provides a schematic part section of a leading edge of an aerofoil 87. As compared to the first embodiment and the second embodiment respectively depicted in FIGS. 3 and 4 and FIGS. 5 and 6, the third embodiment provides for an arrangement which is more suitable to, but not exclusively, rotor blade aerofoils. FIG. 8 provides a section at a plane C-C through an aperture 81 in a separation wall 83 between a radial passage 80 and a chamber 82 in the aerofoil 87 depicted in FIG. 7. In this third embodiment the convergent and curved aperture comprises an entry portion 91 having an elliptical or possibly a circular entry plane 91A and an exit plane that is also elliptical. The aperture 81 accelerates and turns a fluid flow 84B in a similar manner to previous embodiments. However, the exit plane shape 92B is elliptical in shape with its major axis aligned with the flow 84*b* and in this example a radial line 9. An emerging impingement flow 88 strikes an inner opposed surface of the wall 95 of the chamber 82 at an approximately perpendicular angle. This concentrates the flow 88 improving its effectiveness to cover a wider area defined by an elliptical impingement footprint. The fluid flow 88 then exits through the apertures 85 emerging as fluid flow 94.

By provision of elliptical shaped apertures 41, 61, 81 in accordance with the present invention there is a reduction in two dimensional stress associated with providing apertures in load bearing divider wall portions 43, 63, 83 of aerofoils. Furthermore it will be understood that the centre line 41A, 61A, 81A of the respective apertures 41, 61, 81 could be orientated at different angles in order to strike a specific location within the respective chambers 42, 62, 82 for better cooling effect. Nevertheless, the general projection of the impingement jet 48, 68, 88 from the shaped exit portion 52, 72, 92 is such that the angle as well as the impingement footprint is specified for better coolant effect with regard to the available fluid flow 44, 64, 84.

Generally, as will be appreciated a large number of apertures will be utilised possibly in rows or aligned or specific patterns within the divider walls 43, 63, 83 in order to achieve appropriate cooling effects within the chambers 42, 62, 82.

In these three exemplary embodiments, the impingement jets 48, 68, 88 are directed at parts of the wall 95 comprising no apertures 46, 66, 86. However, in some circumstances directing the impingement jets the apertures 46, 66, 86 may be desirable to increase coolant flow therethrough or to enhance cooling around these impingement apertures.

By the above approach more effective utilisation of the available fluid flow in the form of a coolant can be achieved by utilising the static and dynamic feed pressure within a feed passage. The apertures are designed to channel and then effectively turn the fluid flow for appropriate guided impingement to an opposed portion of a chamber surface. By choice of distribution of apertures as well as the pattern of such apertures and their number an improved cooling effect can be provided. It will be understood that the "turning" effect will also improve cooling of the divider wall.

Particular advantage is provided by the present invention in that a higher impingement pressure ratio can be achieved without increasing the feed pressure with inherent problems of reduction of engine efficiency. Furthermore, a more perpendicular impingement flow angle can be achieved creating greater concentration upon a particular desired target area of a surface to be cooled. By such an approach higher levels of internal heat transfer can be achieved resulting in a lower aerofoil leading edge temperature. By providing a lower aerofoil temperature it will be understood that higher gas temperatures can be accepted by the aerofoil or the operational life and therefore durability of the aerofoil can be increased or it may be possible to reduce the level of current flow requirement on a like for like basis so improving operational efficiency and specific fuel consumption. It will also be understood that by appropriate shaping of the apertures there will be reduced stress concentration and therefore improvement in aerofoil durability.

As described above apertures in accordance with the present invention include an elliptical entry portion which bends through the passage and effectively turns the cooling or fluid flow for impingement as required. In such circumstances it will be appreciated through appropriate angling of the apertures impingement jets can be orientated to strike desired locations within a cavity or chamber such as at a suction surface, pressure surface or be directed towards a stagnation point in the aerofoil where greater cooling is required.

Advantageously the apertures may be shaped differently internally possibly having a constant cross sectional area, contact area or a convergent/divergent route between the entry portion and the exit portion to achieve better projection of the impingement flow to an opposed portion of the chamber surface.

In order to improve impingement heat transfer as a result of the coolant or fluid flow additional extended surfaces such as fins, pin fins or tyre tracks etc may be added to the aperture to increase the wetted area of both the aperture and the opposed surface to which the impingement flow is projected.

Within the feed passage in accordance with aspects of the present invention deflectors could be added to turn or deflect the feed fluid flow towards the entrance portions of the apertures. Such deflection would improve entry losses and hence increase the consolidated pressure ratio across the apertures in accordance with aspects of the present invention.

It will be understood that the apertures as indicated are shaped and can be incorporated into any aerofoil feed passage or impingement cavity divider walls between the passage and a chamber. In such circumstances the trailing edge region as well as multiple walls within a cascade of impingement systems could incorporate apertures in accordance with aspects of the present invention.

It will be appreciated that the embodiments of the invention described with regard to FIGS. 3 to 8 can be combined and mixed and matched within the same aerofoil in order to achieve the desired impingement flows for cooling effect. Aspects of the invention depend upon utilisation of an entry portion which is shaped and in particular generally incorporates an elliptical shape to grab the feed flow which allows appropriate guiding and ejection presentation through the exit portion towards a surface for cooling effect.

Modifications and alterations to aspects of the present invention will be appreciated by those skilled in the art. Thus for example the aerofoil arrangement in accordance with aspects of the present invention may be utilised with regard to gas turbine engines used in civil, military, marine or industrial applications. Furthermore, in addition to use of air it will be appreciated that the fluid flow in accordance with aspects of the present invention may be an oil, fuel or water in which the static and dynamic pressure is used to provide an improved impingement pressure and presentation of an impingement flow for cooling effect or other effects.

The invention claimed is:

1. An aerofoil for a gas turbine engine and for use with coolant, the aerofoil comprising:

a divider wall;

a chamber wall;

a passage partly defined by the divider wall, along which the coolant flows;

a chamber defined partly by the divider wall and the chamber wall; and a plurality of feed apertures defined by the divider wall to supply the coolant to impinge on the chamber wall, the feed apertures defining a center-line, an entry plane and an exit plane, at least one of the center-lines of the feed apertures including a continuously curved center-line extending, in a plane parallel to the coolant flow, between the entry plane and the exit plane, wherein the divider wall includes a thickened part through which the feed apertures are defined, the center-line at the entry plane is angled (θ) between 30 and 60 degrees from the coolant flow direction, and the center-line at the exit plane is angled (β) up to 30 degrees to the surface of the chamber wall.

2. The aerofoil of claim 1, wherein the center-line at the entry plane is angled (θ) at approximately 45 degrees from the coolant flow direction.

3. The aerofoil of claim 1, wherein the plurality of apertures comprise apertures having different angles (θ) to preferentially vary the amount of coolant channeled through the apertures.

4. The aerofoil of claim 1, wherein the center-line at the exit plane is angled β at 90+/−10 degrees to the surface of the chamber wall.

5. The aerofoil of claim 1, wherein the plurality of apertures comprise apertures having different angles β to preferentially vary the direction of coolant impinging on the chamber wall.

6. The aerofoil of claim 1, wherein at least one aperture comprises a convergent part between the entry plane and the exit plane.

7. The aerofoil of claim 1, wherein at least one aperture comprises a divergent part between the entry plane and the exit plane.

8. The aerofoil of claim 1, wherein at least one aperture comprises a greater entry plane area than the exit plane area.

9. The aerofoil of claim 1, wherein the plurality of apertures comprises apertures having different entry plane areas to preferentially direct different amounts of coolant therethrough.

10. The aerofoil of claim 1, wherein at least one aperture comprises an elliptical entry plane.

11. The aerofoil of claim 1, wherein at least one aperture comprises an elliptical or circular exit plane.

12. The aerofoil of claim 1, wherein the at least one feed aperture includes a concave surface disposed opposite a convex surface.

13. An aerofoil for a gas turbine engine and for use with coolant, the aerofoil comprising:

a divider wall;

a chamber wall;

a passage partly defined by the divider wall, along which the coolant flows;

a chamber defined partly by the divider wall and the chamber wall; and a plurality of feed apertures defined by the divider wall to supply the coolant to impinge on the chamber wall, the feed apertures defining a center-line, an entry plane and an exit plane, at least one of the feed apertures including a center-line that is non-linear, in a plane parallel to the coolant flow, between the entry plane and the exit plane, the at least one feed aperture including a concave surface disposed opposite a convex surface.

14. The aerofoil of claim 13, wherein the divider wall comprises a thickened part through which the feed apertures are defined, the center-line at the entry plane is angled (θ) between 30 and 60 degrees from the coolant flow direction and the center-line at the exit plane is angled (β) up to 30 degrees to the surface of the chamber wall.

* * * * *